US007104198B2

(12) United States Patent
Weiler et al.

(10) Patent No.: US 7,104,198 B2
(45) Date of Patent: Sep. 12, 2006

(54) PRINTING BLANKET WITH CONVEX OUTER PRINT SURFACE

(75) Inventors: Richard Karl Weiler, Durham, NH (US); James Brian Vrotacoe, Rochester, NH (US); James Richard Belanger, Portsmouth, NH (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 10/795,683

(22) Filed: Mar. 8, 2004

(65) Prior Publication Data

(51) Int. Cl.
*B41F 13/10* (2006.01)

(52) U.S. Cl. ..... 101/376; 101/177; 101/181; 428/909; 492/28

(58) Field of Classification Search ..... 101/375, 101/376, 401.1, 177, 181, 216, 228; 428/909; 492/28, 29, 30, 48, 56
See application file for complete search history.

(56) References Cited

U.S. PATENT DOCUMENTS 5,522,315 A 6/1996 Behnke et al.
5,863,367 A 1/1999 Behnke et al.
6,105,498 A 8/2000 Vrotacoe et al.
6,283,027 B1 9/2001 Vrotacoe et al.
2004/0139871 A1* 7/2004 Knauer et al. ..... 101/216
2004/0153285 A1* 8/2004 Dondi ..... 702/182
2005/0034615 A1* 2/2005 Holm et al. ..... 101/218

OTHER PUBLICATIONS

U.S. Appl. No. 10/617,639, filed Jul. 11, 2003, Printing Blanket With Convex Carrier Layer, Vrotacoe et al.

* cited by examiner

*Primary Examiner*—Andrew H. Hirshfeld
*Assistant Examiner*—Kevin D. Williams
(74) *Attorney, Agent, or Firm*—Davidson, Davidson & Kappel, LLC

(57) ABSTRACT

A tubular printing blanket having an axial center has a carrier sleeve layer having a uniform thickness, a compressible layer, a reinforcing layer over the compressible layer, and a print layer disposed over the reinforcing layer. At least one of the reinforcing layer and the compressible layers has a non-uniform thickness so as to be thicker in the axial center. An outer surface of the print layer is convex.

19 Claims, 2 Drawing Sheets

PRINTING BLANKET WITH CONVEX OUTER PRINT SURFACE

BACKGROUND INFORMATION

The present invention relates generally to offset printing and more specifically to a printing blanket for an offset printing press.

U.S. Pat. Nos. 6,283,027 and 6,105,498, hereby incorporated by reference herein, disclose varying profile blankets, including printing blankets with concave and convex profiles. A concave blanket cylinder is also disclosed.

U.S. Pat. Nos. 5,522,315 and 5,863,367 disclose a printing blanket with a convex compressible layer to spread the web and prevent inward wrinkling, the blanket having a uniform outer circumference.

BRIEF SUMMARY OF THE INVENTION

Commonly-owned U.S. patent application Ser. No. 10/617,639, filed Jul. 11, 2003 and hereby incorporated by reference herein, discloses a printing blanket comprising a carrier sleeve layer having at least one axially convex surface when disposed on a blanket cylinder and a print layer disposed over the carrier sleeve layer. In this application, the convexity of the carrier sleeve layer may be provided, for example, by having the carrier sleeve layer have a uniform inner diameter and a convex outer diameter. The carrier sleeve layer itself is thus thicker in an axial middle than at the ends. Alternately, the carrier sleeve can be of uniform thickness, and the blanket cylinder or a shim may provide the surface convexity.

An object of the present invention is to provide for a uniform carrier sleeve while still permitting a convex outer shape of the printing blanket.

The present invention provides a tubular printing blanket having an axial center comprising:

a carrier sleeve layer having a uniform thickness;

a compressible layer;

a reinforcing layer over the compressible layer; and a print layer disposed over the reinforcing layer;

at least one of the reinforcing layer and the compressible layers having a non-uniform thickness so as to be thicker in the axial center, an outer surface of the print layer being convex.

The combination of a reinforcing layer and/or compressible layer with a thicker center, and an external convex printing surface can permit uniform end-to center print pressure by increasing the overall blanket thickness in the center. The additional pressure in the center helps counteract cylinder deflection effects. The carrier sleeve of uniform thickness simplifies manufacturing.

The compressible layer may be thicker in the center, which can create differential gain from end to center and pull the web flat so as to reduce web wrinkles and improve lateral fit and web handling.

Alternately or additionally, the reinforcing layer can have the non-uniform thickness with a thicker center. The reinforcing layer and the print layer advantageously can be ground using a computer numerical control (CNC) grinder, or a concave grinding mandrel. A vacuum may be used with the concave grinding mandrel to ensure contact with between the blanket and the mandrel surface.

If only one of the compressible layers and reinforcing layers is thicker in the center, the other of the layers is preferably of uniform thickness.

The print layer may be of uniform thickness or non-uniform thickness. Preferably, the print layer is thinner in the axial center.

The formation of the layers is preferably such that the blanket, when disposed on a blanket cylinder, preferably provides uniform axial print or nip pressure across the width of the blanket.

The print layer, reinforcing layer and compressible layers preferably are gapless.

The reinforcing layer may be made for example made of wound fibers or textile fabric, or for example of urethane.

Also provided by the present invention is an offset print unit comprising an image cylinder, a blanket cylinder having a uniform outer radius, and the printing blanket disposed over blanket cylinder.

The blanket cylinder and blanket are most advantageous for narrow blanket cylinders with a wide axial extent, as these are most prone to bending. Thus, the blanket advantageously carries at least two images axially, and may carry at least three images in the axial direction while only one image is carried in the circumferential direction. Four axial images may be most advantageous.

BRIEF DESCRIPTION OF THE DRAWINGS

The present invention will be further described with respect the following Figures, in which.

DETAILED DESCRIPTION

Figure 1:
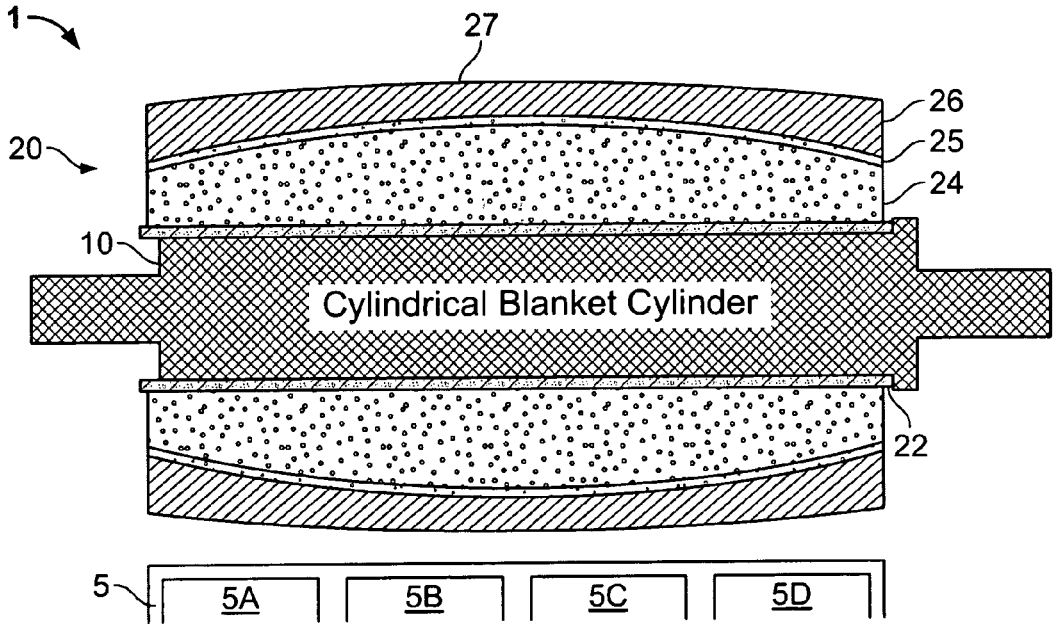
FIG. 1 shows schematically an embodiment of the present invention with the compressible layer having a non-uniform thickness.

FIG. 1 shows schematically a print unit 1 with a blanket cylinder 10 having a uniform radius outer surface 11. Blanket cylinder 10 may be made of metal, for example steel. A blanket 20 fits over blanket cylinder 10, for example by sliding axially, and blanket cylinder 10 may be provided with air holes for providing pressurized air for this purpose.

Blanket 20 includes a carrier sleeve layer 22, which may be made for example of a fiberglass sleeve available commercially from Rotec GmbH & Co. KG of Ahaus-Ottenstein, Germany. Carrier sleeve layer 22 preferably is solid and rigid enough to maintain a tubular shape to permit axial placement of the blanket 20 on blanket cylinder 10, yet flexible enough to permit the expansion necessary fit the blanket 20 over the cylinder 10.

Carrier sleeve 22 is of uniform thickness and a compressible layer 24 wider in an axial center section than at the axial ends of blanket 20 is located over the carrier sleeve 22. Compressible layer 24 may be, for example, rubber with air bubbles formed intentionally therein or microspheres located therein to provide compressibility.

A reinforcing layer 25, for example a thread or fabric layer of uniform thickness, or for example urethane, may be located over compressible layer 24. If made of a grindable substance, for example urethane, the reinforcing layer can be ground using a CNC grinder or concave grinding mandrel, for example.

A print layer 26 forms the outer layer, and may be made, for example, of solid rubber. The print layer 26 has an outer print surface 27 which is convex when the blanket 20 is on blanket cylinder 10 and no pressure is applied to blanket 20. Print layer 26 preferably is of non-uniform thickness and thinner in the axial center. Print layer 26 can be ground to shape using for example a CNC grinder or a concave grinding mandrel.

Print surface 27 is inked by an image cylinder, for example a plate cylinder 5 which is brought into contact with the blanket 20 once the blanket 20 is mounted. The image cylinder may have for example four image areas 5A, 5B, 5C, 5D axially, each image area covering the circumference of image cylinder 5, a so-called one around configuration. However, image cylinder 5 could also have two (or more) images spaced circumferentially, a so-called two (or more) around configuration.

Preferably, the number of axial images is at least twice the number of circumferential images, and may be three, four or more times the number of circumferential images, as the present invention is most advantageous with small diameter, large width blankets.

Figure 2:
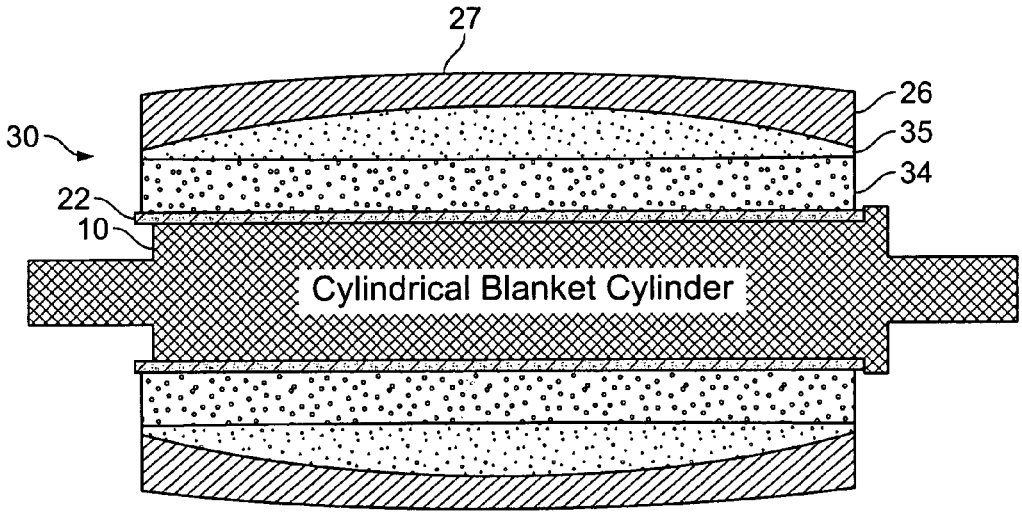
FIG. 2 shows schematically another embodiment of the present invention with reinforcing layer having a non-uniform thickness.

FIG. 2 shows an alternate blanket 30 in which compressible layer 34 has a uniform thickness, and the reinforcing layer 35 is thicker in the middle, with the other components being similar to that in the FIG. 1 embodiment.

The present invention is particularly advantageous for printing webs, and printing press preferably is a lithographic offset web printing press.

LIST OF DRAWING NUMBERS

1 print unit
5 image cylinder
5A–D image areas
10 blanket cylinder
20 blanket
22 carrier sleeve layer
24 compressible layer
25 reinforcing layer
26 print layer
27 print surface
34 compressible layer
35 reinforcing layer

What is claimed is:

1. A tubular printing blanket having an axial center comprising:

a carrier sleeve layer having a uniform thickness;

a compressible layer;

a reinforcing layer over the compressible layer; and a print layer disposed over the reinforcing layer;

at least one of the reinforcing layer and the compressible layers having a non-uniform thickness so as to be thicker in the axial center, an outer surface of the print layer being convex;

wherein the print layer is thinner in the axial center.

2. The blanket as recited in claim 1 wherein the compressible layer is thicker in the axial center.

3. The blanket as recited in claim 2 wherein the reinforcing layer has a uniform thickness.

4. The blanket as recited in claim 1 wherein the reinforcing layer is thicker in the axial center.

5. The blanket as recited in claim 4 wherein the compressible layer is of uniform thickness.

6. The blanket as recited in claim 1 wherein the blanket provides uniform axial print or nip pressure across a width of the blanket.

7. The blanket as recited in claim 1 wherein the print layer is gapless.

8. The blanket as recited in claim 1 wherein the reinforcing layer is gapless.

9. The blanket as recited in claim 1 wherein the compressible layer is gapless.

10. The blanket as recited in claim 1 wherein the carrier sleeve layer is gapless.

11. An offset print unit comprising an image cylinder, a blanket cylinder having a uniform outer radius, and the printing blanket as recited in claim 1 disposed over the blanket cylinder for contact with the image cylinder.

12. The offset print unit as recited in claim 11 wherein the image cylinder carries at least twice the number of image areas axially as circumferentially, the number of image areas in an axial direction being exactly four.

13. The offset print unit as recited in claim 12 wherein the image cylinder carries at least three times the number of image areas axially as circumferentially.

14. The offset print unit as recited in claim 11 wherein the image cylinder carries at least four image areas axially.

15. A method for manufacturing a printing blanket having an axial center comprising the steps of:

disposing a compressible layer over a carrier sleeve layer having a uniform thickness;

disposing a reinforcing layer over the compressible layer; and disposing a print layer disposed over the reinforcing layer, the print layer being thinner in the axial center;

at least one of the reinforcing layer and the compressible layers having a non-uniform thickness so as to be thicker in the axial center, an outer surface of the print layer being convex.

16. The method as recited in claim 15 wherein the reinforcing layer has a non-uniform thickness and is ground.

17. The method as recited in claim 16 wherein the reinforcing layer is ground using CNC control.

18. The method as recited in claim 15 wherein the print layer is ground.

19. The method as recited in claim 18 wherein the print layer is ground using CNC control.

* * * * *

UNITED STATES PATENT AND TRADEMARK OFFICE

CERTIFICATE OF CORRECTION

PATENT NO. : 7,104,198 B2
APPLICATION NO. : 10/795683
DATED : September 12, 2006
INVENTOR(S) : Richard Karl Weiler, James Brian Vrotacoe and James Richard Belanger It is certified that error appears in the above-identified patent and that said Letters Patent is hereby corrected as shown below:

On the title page, insert the following prior publication data in paragraph (65) Prior Publication Data:

-- US 2006/0032388 A9 Feb. 16, 2006 --.

Signed and Sealed this

Ninth Day of January, 2007

JON W. DUDAS
*Director of the United States Patent and Trademark Office*